US005139426A

United States Patent [19]

Barkus et al.

[11] Patent Number: 5,139,426

[45] Date of Patent: Aug. 18, 1992

[54] ADJUNCT POWER CONNECTOR

[75] Inventors: Lee A. Barkus, Millersburg; Matthew M. Sucheski, Harrisburg, both of Pa.

[73] Assignee: AMP Incorporated, Harrisburg, Pa.

[21] Appl. No.: 805,237

[22] Filed: Dec. 11, 1991

[51] Int. Cl.[5] ..... H01R 13/00

[52] U.S. Cl. ..... 439/65

[58] Field of Search ..... 439/65, 76, 629-638

[56] References Cited

U.S. PATENT DOCUMENTS

| | | | |
|---|---|---|---|
| 3,136,591 | 6/1964 | Just et al. | 439/65 |
| 4,077,694 | 3/1978 | Cobaugh et al. | 339/176 |
| 4,241,381 | 12/1980 | Cobaugh et al. | 361/413 |
| 4,384,754 | 5/1983 | Douty et al. | 439/65 |
| 4,451,107 | 5/1984 | Dola et al. | 439/65 |
| 4,755,145 | 7/1988 | Johnson et al. | 439/61 |

*Primary Examiner*—Joseph H. McGlynn

*Attorney, Agent, or Firm*—Katherine A. Nelson

[57] ABSTRACT

An adjunct electrical connector (44–60) includes a mechanical line (52) added to a signal connector half (34) to increase power transfer between circuit boards (12, 24). The power connector includes contacts of a given cross-section to carry a given current with the contacts having a plurality of posts (50, 70) spaced apart and of a lesser cross-section to carry a fraction of the given current so as to distribute such current to thin conductive traces (32) on the said board half with said post being on the centers of holes in said printed circuit board (24).

9 Claims, 5 Drawing Sheets

ADJUNCT POWER CONNECTOR

This invention relates to an electrical power connector which is added to a circuit, such as a circuit board, to increase the power transfer capacity between circuits.

BACKGROUND OF THE INVENTION

A widely used technique for packaging complex electronic apparatus employs circuits, such as the circuits of circuit boards, carrying components arranged in modules which are interconnected together through connectors mechanically and electrically mounted on such boards. In a typical arrangement, a backpanel, or mother board, is provided which accommodates multiple daughter boards and connectors providing large numbers of signal interconnections that link the circuits of mother and daughter boards to components and to input and output transmission paths on the boards, as well as power and ground circuits for the components. Because of the low cost of photo-lithographic processing techniques, the circuits on such boards are formed by either subtractive processes wherein a thin foil of copper is etched away; or, conductive material in the form of resin bound ink is printed on the boards and subsequently electroplated to build up conductivity of the circuits. In both instances, the conductive circuits are quite thin, which, although more than suitable to carry the low milliamp and microamp currents of signals, cannot carry the higher currents, amperes and tens of amperes necessary for providing power to the components mounted on the daughter boards without excessive heating. Additionally, ground circuits which may interconnect to the components must also carry current levels frequently in excess of the capability of the thin foil or traces on the boards. To this end, bus bars of high conductivity and substantial cross-sectional area are employed on the mother board to transmit the high power levels for ground and power interconnections with the daughter boards having separate contacts tapping into the power of the bus bars. U.S. Pat. No. 4,755,145 shows one example of this technique, wherein a plurality of daughter printed circuit boards are detachably mounted on a backplane and connected to a bus bar on the same side of the backplane by contacts on the daughter board. In this prior art example, multiple contact receptacles are utilized to interconnect to a given bus bar and to distribute the energy therefrom to circuits on the daughter board. The bus bars shown therein are relatively exposed and form, in essence, blades which insert into the receptacles of the contacts mounted to the daughter board. Two problems arise in utilizing the techniques of the aforementioned prior art. The first one is that the bus bars are exposed and can be readily touched by those assembling or disassembling the boards together, or by probes employed by users of the assembly; both of which procedures can lead to safety and circuit problems. A second problem has to do with the fragile nature of small receptacle contacts which can be readily deformed or damaged in handling, assembly, and use.

Accordingly, it is an object of the present invention to provide an adjunct power connector designed to interconnect power and/or ground voltages and currents between the circuits such as those of printed circuit boards. It is a further object to provide a rugged power contact which is compatible with connecting power and ground circuits to the thin conductive traces of printed circuit boards. Still a further object is to provide a power connector which may be readily added to printed circuit boards to extend the power capacity for higher voltages and currents called for by the boards. It is yet a further object to provide a power connector which is capable of carrying appreciable currents and yet can be utilized with printed circuit boards having holes accessing circuits, which holes are on common centers throughout the board, signal and power.

SUMMARY OF THE INVENTION

The present invention achieves the foregoing objectives through the provision of a power connector that includes a plug having a blade of a conductivity and cross-sectional area to carry substantial currents without excessive heating and further a plurality of posts integral with the blade that effectively distribute the current carried by the blade to individual holes and regions of conductive traces on a secondary or daughter board. The connector of the invention includes a receptacle having a plurality of resilient springs of a dimension to receive the blade and interconnect power and ground paths to a mother board, through a bus mounted on the surface of the board or other power buses mounted within or on the opposite side of the board. The receptacle portion of the power connector is dimensioned in terms of the resilient contacts to also receive the daughter board inserted therein and interconnect to power traces on the surfaces of such board. In accordance with the concept of the invention, the power plug contact may be added to the power circuits of the board to act as an auxiliary or adjunct interconnection of power and ground current levels. The plug contact of the invention may be added in multiples to a given board with the posts on centers compatible with the centers of the board also utilized for signal contacts and the added power contacts are linkable to a signal connector mounted adjacent to such power contacts. A link engaging the posts of the power plug contact is employed to fix and position the power plug contact relative to the signal half of the connector mounted on the daughter board. Multiple power contacts may be employed utilizing multiple links which have surfaces allowing a stacking of links relative to the signal connector half and on centers engaging appropriately mounted receptacle power contacts on the mother board.

DETAILED DESCRIPTION OF THE INVENTION

Figure 1:
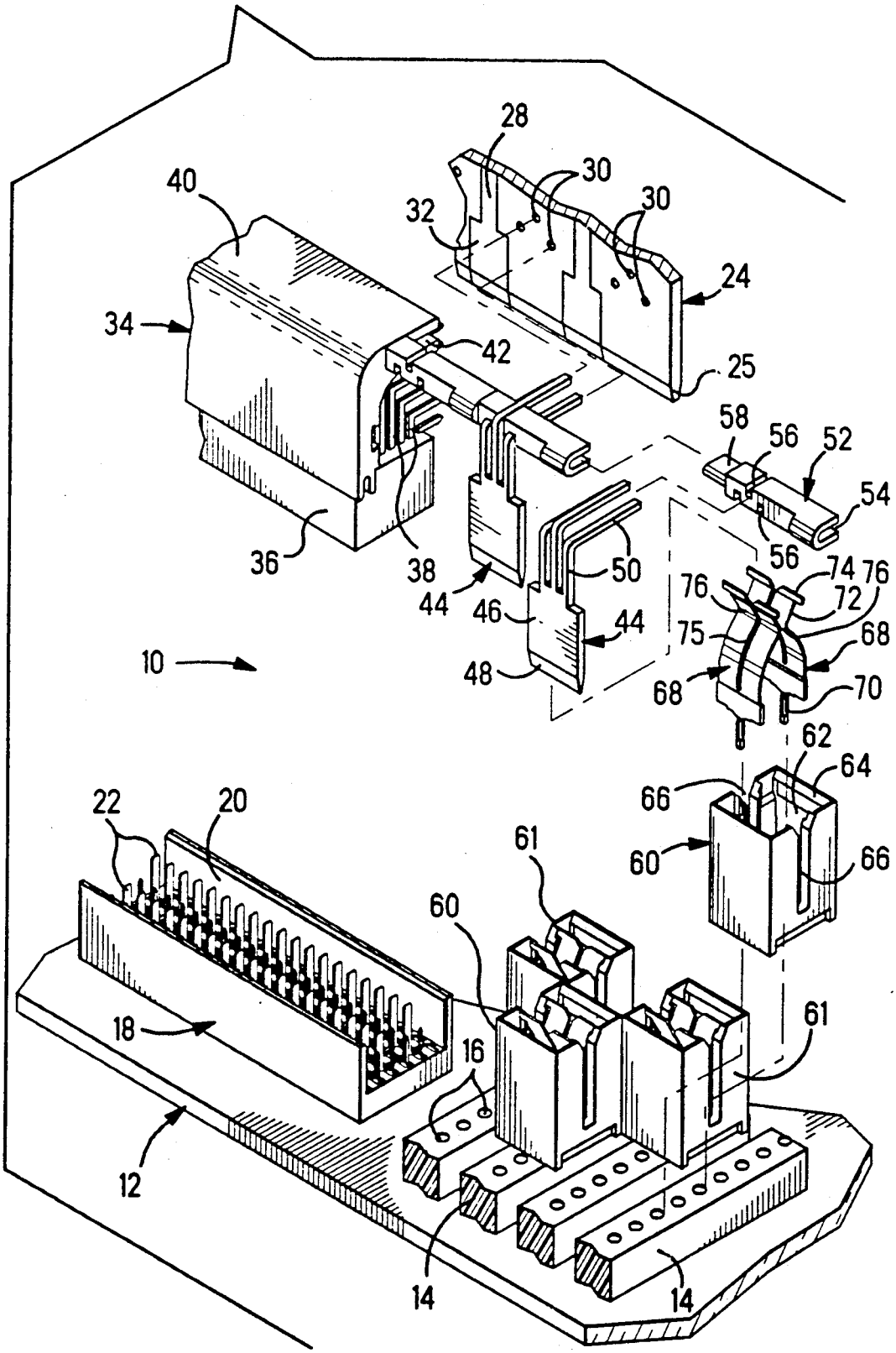
FIG. 1 is a perspective partially exploded view of the elements of the connector of the invention in association with signal connectors and circuit boards.

Referring now to FIG. 1, an assembly 10 is shown to include a backpanel or mother board 12 in relation to a daughter board 24 which represents a number of such daughter boards employed in relationship to board 12 to interconnect components on the daughter board, not shown, which, together, provide a functioning device, such as a computer. The mother board 12 includes on the upper surface thereof, a plurality of buses 14 formed of high conductive metal apertured at 16 and interconnected by means not shown to the conductive traces on the surfaces or within board 12 and laminations thereof which provide power and ground distribution for such board. Also shown in FIG. 1 is a signal connector 18 which includes a plastic housing 20 and arrays of contacts 22 held in such housing. The contacts 22 have ends, not shown, which join signal circuits within board 12. These circuits may be in strip line or other form, requiring ground and signal conductive traces so spaced relative to dielectric material to minimize cross-talk and control and pedance for signal transmission efficiency. The grounding circuits interconnected by the buses 14 are for carrying substantially more current than those just mentioned, currents I which are on a level in terms of amperes to create potentially substantial heating problems through $I^2R$ losses. In a typical assembly 10, there would be numbers of mother board connectors 18 arranged on the upper surface thereof and served by numbers of buses 14 extending across such surface. FIG. 1 shows the daughter board 24 having beveled lead surface 25 and a plurality of holes 30 which extend therethrough to interconnect various circuit traces, such as 28, representing a power and/or ground trace, by plated-through holes 30 throughout the daughter board. Pad 32 is provided on one edge surface of board 24 interconnecting the ground and/or power trace 28, it being understood that numbers of traces 28 are typically utilized for accommodating either power or ground, or power of different voltages to the different components that are mounted on the board and interconnected to the circuits formed thereby. Such components would also be connected to signal traces, not shown in FIG. 1, but interconnected to a signal connector half, such as 34, which includes a plastic housing 36 and a plurality of conductive contacts 38, which terminate on one end in receptacles (not shown) adapted to receive the contacts 22 of signal connector half 18 mounted on board 12, and at the other end, posts on centers to fit within the plated-through holes of board 24. The signal connector half 34 shown in FIG. 1 also includes a stiffener 40 of the configuration indicated, which may be typically an extrusion of aluminum or the conductive metal suitably formed to fit onto housing 36 and cover over the signal pathways defined by contacts 38. The stiffener 40 includes, in the embodiment shown in FIG. 1, an internal recess 42 extending along the top thereof, as well as other recesses suitable for linking multiple connectors 34 together on top of a board 12.

The invention power connector is comprised of a plug contact 44 and a receptacle housing 60 having receptacle contacts 68 disposed therein. The plug contact 44 includes a blade 46 of substantial cross-sectional dimension and is to represent a relatively high bulk conductivity to carry substantial currents without undue $I^2R$ heating. The blade 46 has a tapered lead-in 48 and dimensions, in terms of thickness, to fit within the receptacle contacts 68 of the power receptacle portion of the connector.

In a first embodiment contact 44 is thinner than the thickness of the circuit board edge 25. The beams of receptacle contacts 68 therefore are spaced more closely together for mating with blade 44 than are those mating with the circuit board.

Figure 2:
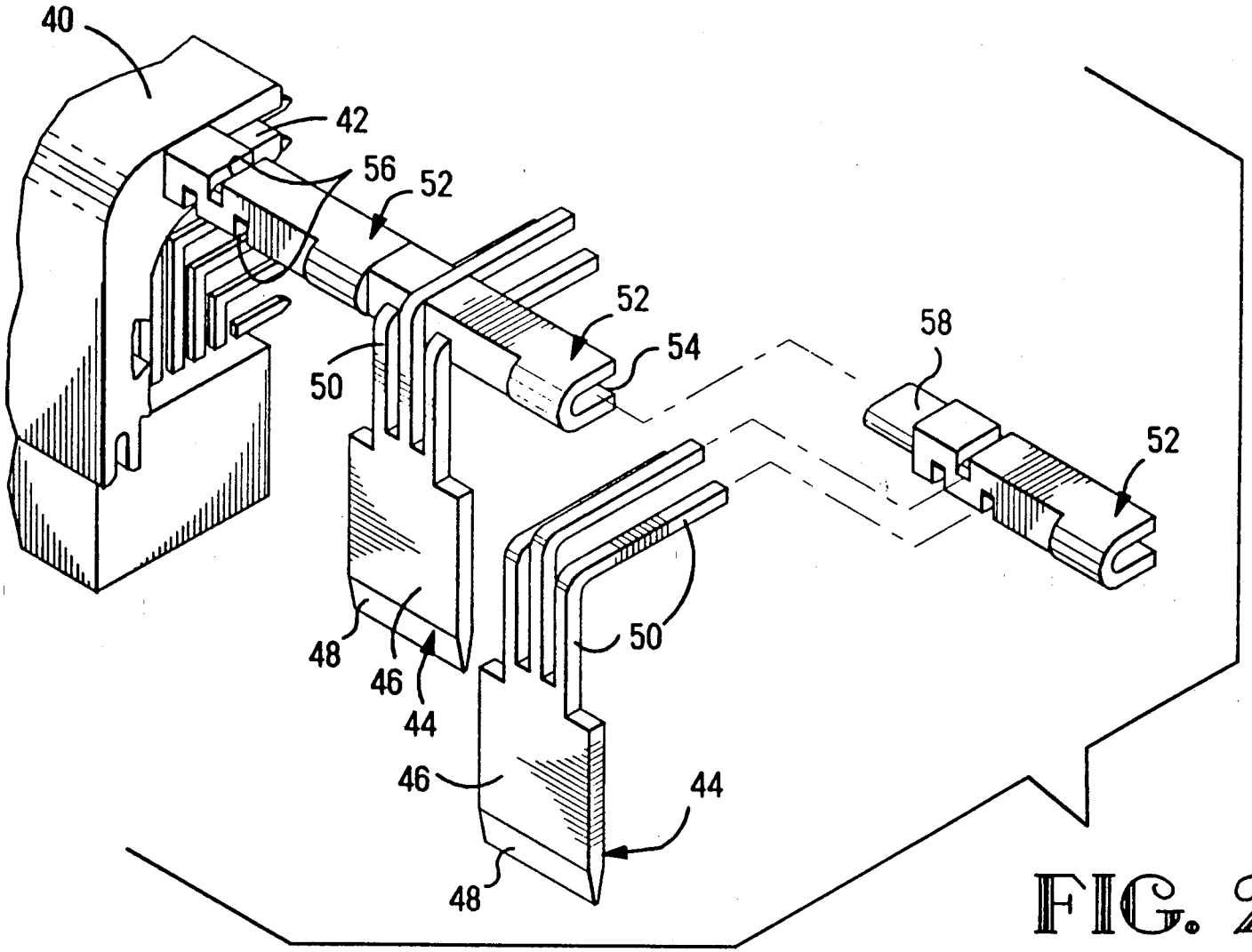
FIG. 2 is an enlarged view of portions of the plug contact of the invention in the same perspective shown in FIG. 1.
Figure 3:
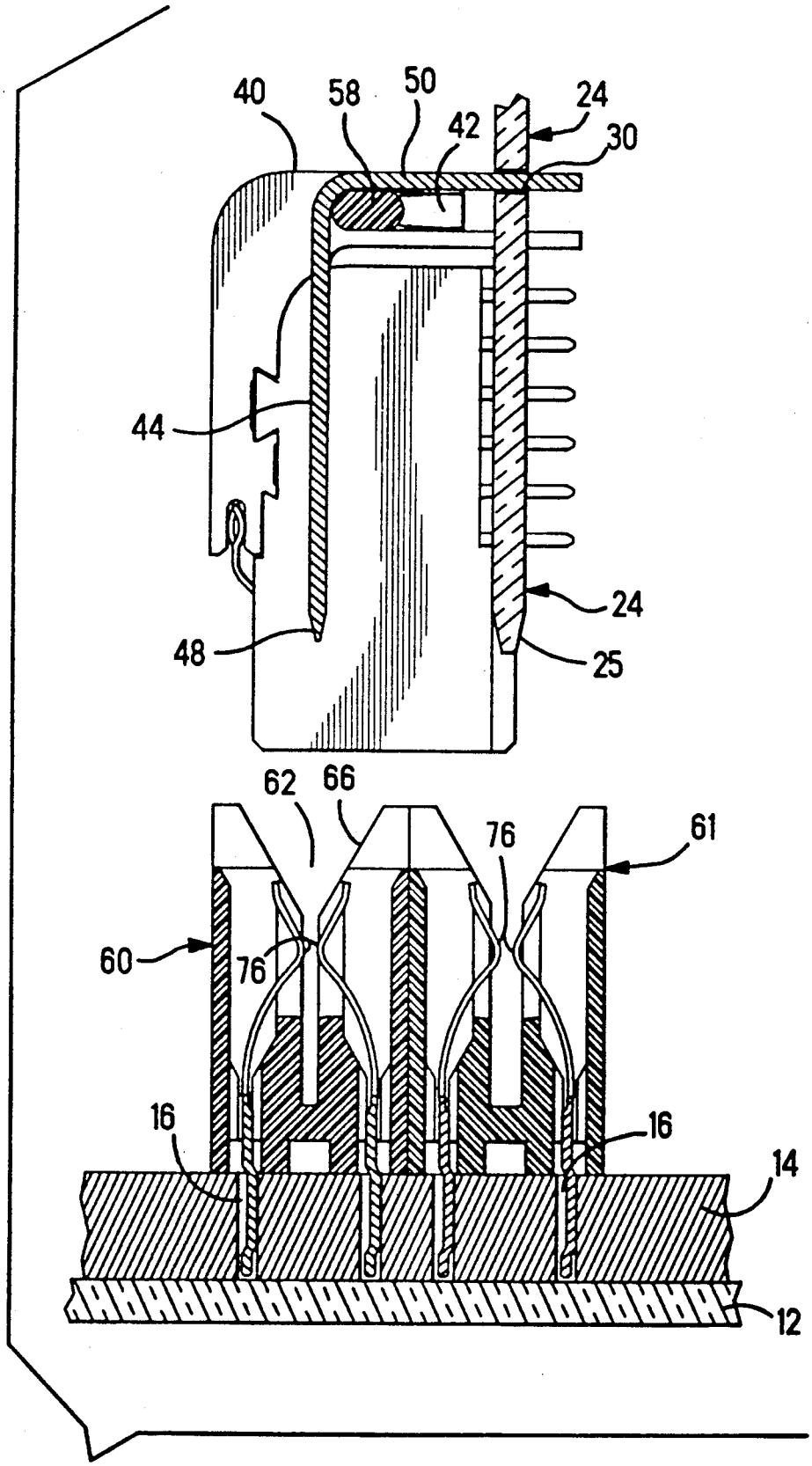
FIG. 3 is a side, elevational, and partially sectioned view showing the mother and daughter boards and the power connector of the invention prior to intermating.
Figure 4:
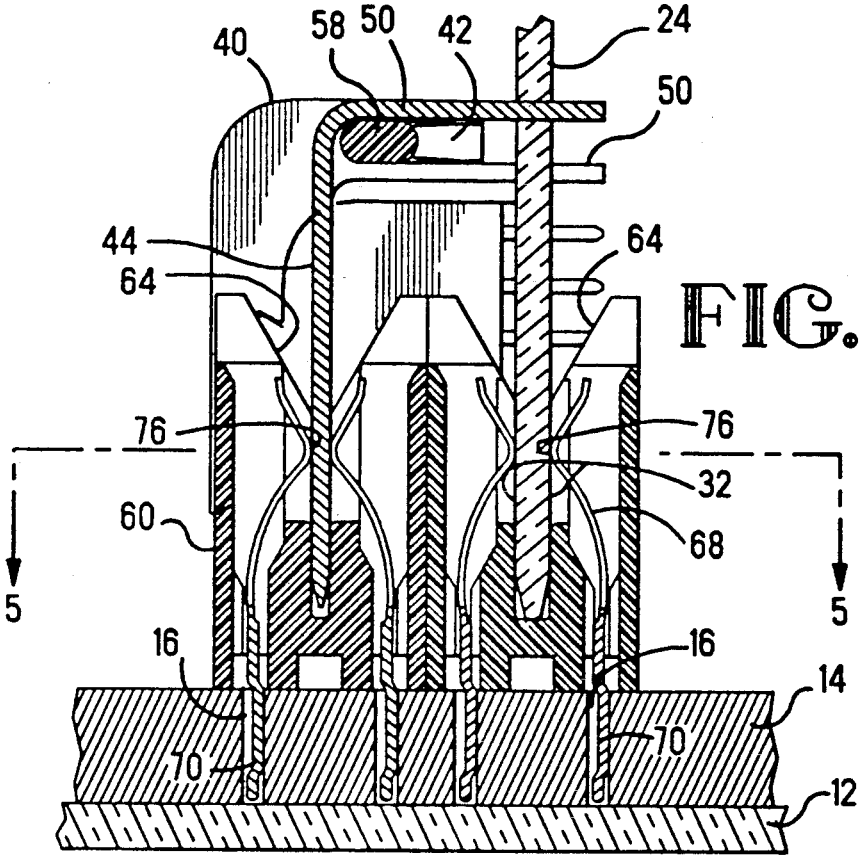
FIG. 4 is a view of the elements of FIG. 3 shown mated, the view being taken along line 4—4 of FIG. 5.

As can be seen in FIG. 1, and additionally in FIGS. 2–4, the power contact 44 includes a plurality of posts 50 formed integrally with blade 46 and which are of reduced cross-section and reduced capacity for carrying current. The posts 50 are curved at right angles, as shown, with the ends on centers compatible with the centers of the plated-through holes 30 on board 24. To be noted is the fact that the posts 50 are on the same center as the posts of contacts 38 of the signal connector, thus allowing a simplified and less costly processing of the boards 24, having common centers throughout. FIG. 1 also shows a mechanical link 52 which is formed of dielectric and plastic material to include a recess 54 in one end and a plurality of recesses 56 in the body, arranged to receive the posts 50 of power contact 44. At the end opposite recess 54 is a plug 58 integrally formed of the material of link 52. The post 58 is dimensioned to fit within the recess 42 of stiffener 40 and thus fix the position of power contact 44 relative thereto and relative to board 24. The link 52 also serves to align the posts 50 of power contact 44 to facilitate insertion of the contact. To be noted further is the feature wherein numbers of power contacts 44 may be linked physically and dimensionally to a given signal connector half 34 by virtue of stacking the links 52, containing the posts 50 of contacts 44 as shown in FIG. 1.

Figure 5:
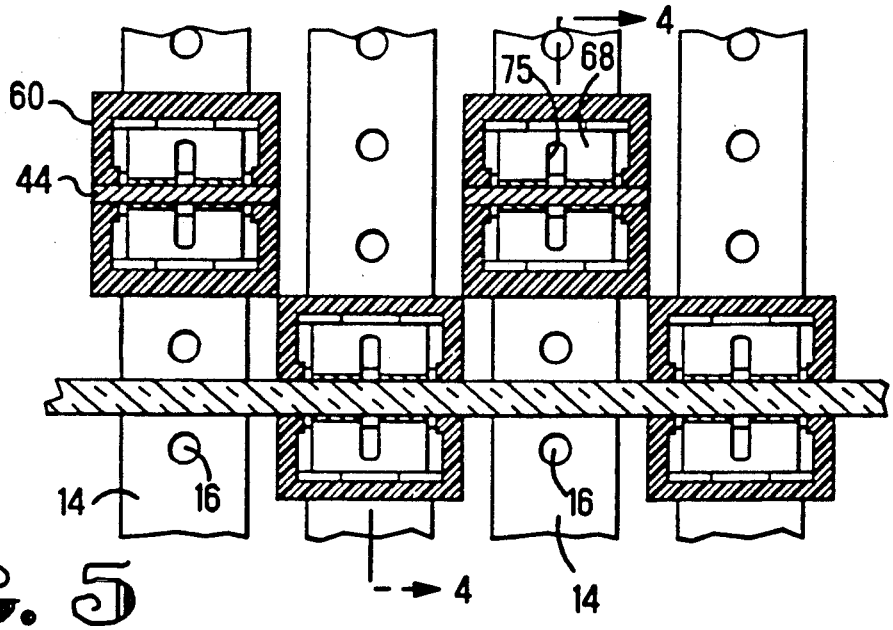
FIG. 5 is a plan view, partially sectioned, taken through lines 5—5 of FIG. 4.

As also shown in FIGS. 1–5, the power connector includes a receptacle half 60, which is comprised of a outer plastic housing 62 having beveled leading 64, including a slot 66 in each side of the housing 60 allowing a blade 44 or board 24 to extend therethrough, thus facilitating the use of multiple power connectors with a given board 24 as shown in FIG. 5. Two such receptacles 60 are shown in FIG. 1 mounted to bus bars 14 for engaging the two blade contacts 44. Two receptacles 61 engage the leading edge 25 of circuit board 24. As can be seen in FIGS. 1–5, the thickness of daughter board 24 is greater than that of blades 44. The leading edge 25 of board 24 is received in receptacles 61, which have the same basic structure as receptacles 60, except they are dimensioned to accommodate the thickness of the board. It is to be understood that a host of such connectors may be employed in a like manner.

Contained within the receptacle housing 62 are a pair of resilient spring contacts 68 having posts 70 extending from the bottom thereof and inwardly curved spring sections 72 that end in the opposite direction from the posts 70 at 74 and are bifurcated at 75. This configuration defines four points of contact for each receptacle 60, contact points 76 being shown in FIG. 1 and in FIGS. 3 and 4. As indicated in FIGS. 3 and 4, the posts 70 are shaped to define compliant spring sections that enter the holes 16 and provide a mechanical and electrical connection to the bus bars 14. The invention contemplates that more than one post 70 may be used per spring half of receptacle spring contacts 68.

With the receptacle contacts and housings 60,61 mounted as shown in FIG. 3, the spring contacts 68 are positioned within the housings 62 to receive and interconnect to both the board 24, the surface circuit 32 thereof, and the power plug contacts 44. The bevel lead in surface 66 on the housing 62 and the bevels 25 and 48 on the board and plug contacts respectively facilitate an easy entry of the daughter board assembly relative to the mother board receptacle connector half. FIG. 3 also shows the plug 58 of link 52 entered into the recess 42 of stiffener 40. FIG. 4 shows the connector halves of FIG. 3 plugged together with the circuits 32 of board 24 contacting at points 76 the receptacle spring contacts 68, and, as well, the contact points 76 of spring 68 of an adjacent power connector contacting the blade 44 of the plug contact of the power connector of the invention. FIG. 5 shows the interrelationship of connections of blade and board viewed in a vertical sense, there being two power connectors for the board and two power connectors for the blade adjunct circuits.

Figure 6:
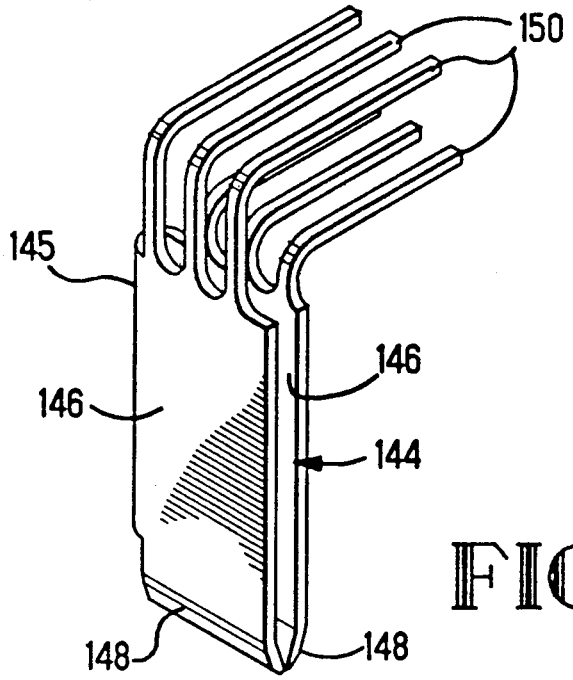
FIG. 6 is a perspective view of an alternative embodiment of the plug contact.
Figure 7:
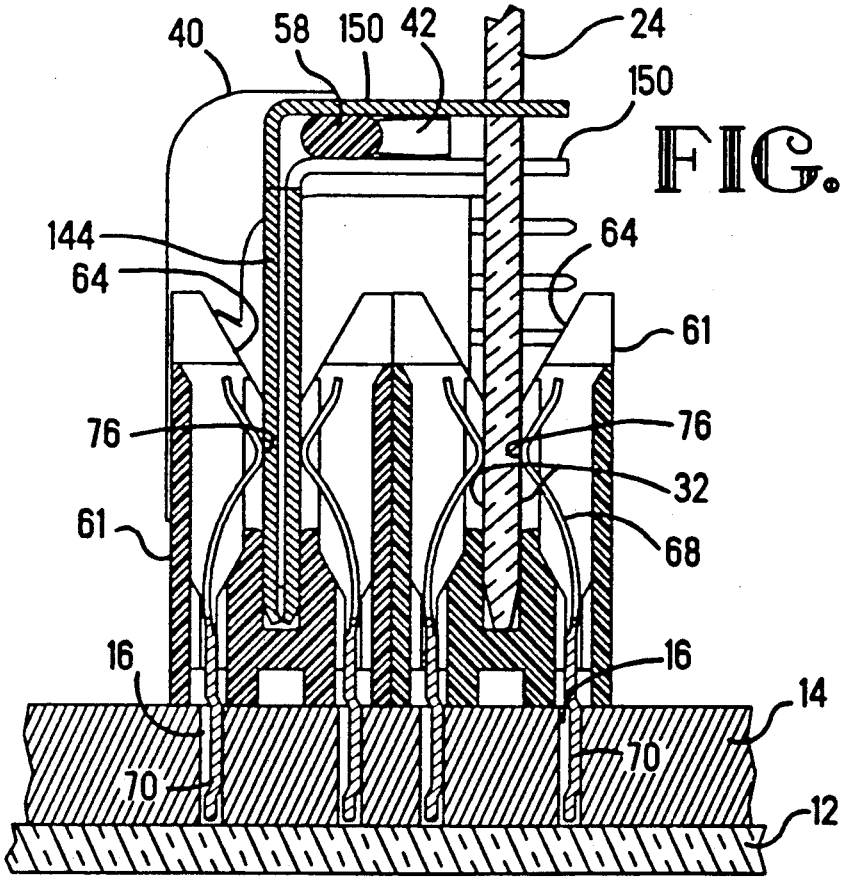
FIG. 7 is a view similar to FIG. 4 showing the contact of FIG. 6 mated to the receptacle contact

FIGS. 6 and 7 show an alternative embodiment 144 of the power contact which is a U-shaped member having two blade portions 146 and two lead leading ends 148 which overlie each other with the bight 145 of the U extending along the side of contact 144. The double thickness of contact 144 provides a structure having the same thickness as board 24 so that the same receptacle 61 can be used for the board and blade, thereby minimizing the number of different parts needed for the assembly.

As can be appreciated, the invention power connector can be utilized to add to the power carrying capability of a given electronic package by design, initially, or can be added at a later time if there is sufficient surface on a given assembly. This latter feature is useful as circuit functions are added and additional daughter boards with additional functions are added to a given backpanel due to continuing innovations relating to a particular computer or other electronic device. This additional power capacity offered by the invention power connector allows the use, as has been mentioned, of standardization of hole centers on boards, of the readily producible thin conductive traces of processing techniques and distributes the power to the board circuits to preclude undue heating of the circuits of the daughter board.

Having now described the invention in terms related to drawings to explain it, claims are appended, intended to define the invention.

We claim:

1. An electrical power connector of a type to be added to a signal connector to transfer power between circuit boards of a type having circuit holes on given centers for signal and power circuits carried by said boards and interconnected by the mating halves of the signal connector and power connector, the power connector including plug and receptacle power contacts separately mounted to circuit boards with means linking the plug contacts to the signal connector half of one of the boards to position such plug contacts relative thereto, each said power contact having a given cross-sectional area of conductive material to carry a given current and further including a plurality of post portions spaced apart on the said given hole centers to engage and interconnect to spaced apart regions of the conductive trace of at least one of said boards with each said portion of a cross-sectional area to carry a fraction of said given current to distribute current to said trace and preclude unwanted $I^2R$ heating of the trace and portions in engagement with the trace.

2. The connector of claim 1 wherein the said means is comprised of a link including a surface extending along the length to receive and position the post portions of said plug contact relative to holes in the circuit board connected to the conductive traces of said board.

3. The connector of claim 1 wherein the said receptacle contact comprised of a plurality of spring contacts spaced to receive and interconnect to one of the circuit boards and to the plug contact of the power connector.

4. The connector of claim 1 wherein the said means is comprised of a link having a recess at one end and a projection at the opposite end to facilitate joining a plurality of links end to end to add multiple power connectors to a signal connector on one of said boards.

5. The connector of claim 1 wherein said means includes a link comprised of a plastic insulating material having a series of recesses along the length to receive the posts of the power contact and align such posts for insertion in a circuit board and includes further access at one end thereof, and a projection at the other, such that the link can be fitted into a signal connector having a recess in the side surface thereof to position the power contact relative to said connector.

6. The connector of claim 1 wherein said plug contact is comprised of a blade at one end of a substantial cross-sectional thickness sufficient to carry the given current and integral therewith a plurality of posts extending from the other end with such posts positioned to define post ends in spaced apart positions to fit in the holes of the circuit board on said given centers.

7. The connector of claim 1 includes a plurality of receptacle contacts spaced apart by a dimension sufficient to interconnect with the plug contact and with a circuit board.

8. In combination a pair of circuit boards containing circuit traces with at least one board including components interconnected by said circuit traces with the one board including holes on given centers joining said traces, a signal connector having one half mounted and connected to one board and a mating half mounted and connected to the other board, an adjunct power connector for adding power interconnections between boards including at least one power receptacle mounted to the one board and connected to the circuits of the one board, and at least one power plug mounted to the other board connected to circuits of the other board, said plug having a blade of a cross-section to carry a given level of current and a plurality of posts integral therewith of lesser cross-sectional area each carrying a fraction of said given current, the post extending from said blade on the given centers of said boards to distribute the current carried by the power connector to the board circuits and minimize $I^2R$ heating of the said traces while providing power between the said boards.

9. The combination of claim 8 including a plurality of power connectors and a mechanical link between the plug contacts and the signal connector of the other board to align and position the plug contacts relative thereto.

* * * * *

UNITED STATES PATENT AND TRADEMARK OFFICE

CERTIFICATE OF CORRECTION

PATENT NO. : 5,139,426

DATED : August 18, 1992

INVENTOR(S) : Lee Andrew Barkus, et al.

It is certified that error appears in the above-identified patent and that said Letters Patent is hereby corrected as shown below:

In the Abstract

Line 2 - change "line" to -- link --.

Signed and Sealed this

Twelfth Day of October, 1993

*Attest:*

Bruce Lehman

BRUCE LEHMAN

*Attesting Officer*

*Commissioner of Patents and Trademarks*